United States Patent [19]

Wunderlich

[11] Patent Number: 4,931,806

[45] Date of Patent: Jun. 5, 1990

[54] WINDOW MOUNTED ANTENNA FOR A CELLULAR MOBILE TELEPHONE

[75] Inventor: Blake A. Wunderlich, LaGrange, Ill.

[73] Assignee: The Antenna Company, Countryside, Ill.

[21] Appl. No.: 194,466

[22] Filed: May 16, 1988

[51] Int. Cl.[5] ..... H01Q 1/32

[52] U.S. Cl. ..... 343/715; 343/713; 343/900

[58] Field of Search ..... 343/713, 715, 900, 829, 343/846, 847, 848

[56] References Cited

U.S. PATENT DOCUMENTS

| | | | |
|---|---|---|---|
| 4,238,799 | 12/1980 | Parfitt | 343/715 |
| 4,621,243 | 11/1986 | Harada | 343/715 |
| 4,779,098 | 10/1988 | Blaese | 343/715 |
| 4,785,305 | 11/1988 | Shyu | 343/715 |
| 4,794,319 | 12/1988 | Shimazaki | 343/715 |

FOREIGN PATENT DOCUMENTS

| | | | |
|---|---|---|---|
| 0137391 | 4/1985 | European Pat. Off. | 343/715 |
| 3410950 | 9/1985 | Fed. Rep. of Germany | 343/715 |
| 2172148 | 9/1986 | United Kingdom . | |
| 8700974 | 2/1987 | World Int. Prop. O. . | |

*Primary Examiner*—Rolf Hille
*Assistant Examiner*—Doris J. Johnson
*Attorney, Agent, or Firm*—Lockwood Alex Fitzgibbon & Cummings

[57] ABSTRACT

A window-mounted cellular mobile telephone antenna includes an outside module for mounting on the outside surface of a vehicle window in registration with an inside module mounted on the inside surface of the window. The outside module includes a capacitive coupling element and a generally vertical radiating element not less than $\frac{5}{8}$ wavelength at the antenna operating frequency. The inside module includes a self-contained electrical circuit forming a ground-plane for the radiating element, an inductor for matching the impedance of the radiating element to that of a coaxial feedline, and a capacitive coupling element interacting with the coupling element of the outside module and the dielectric of the window glass to form a coupling capacitor. The length of the radiating element may be increased beyond $\frac{5}{8}$ wavelength to reduce impedance matching requirements in the inside module.

6 Claims, 4 Drawing Sheets

FIG. 5
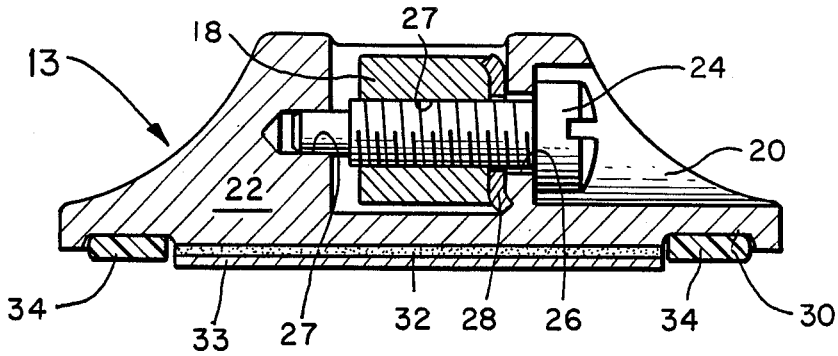
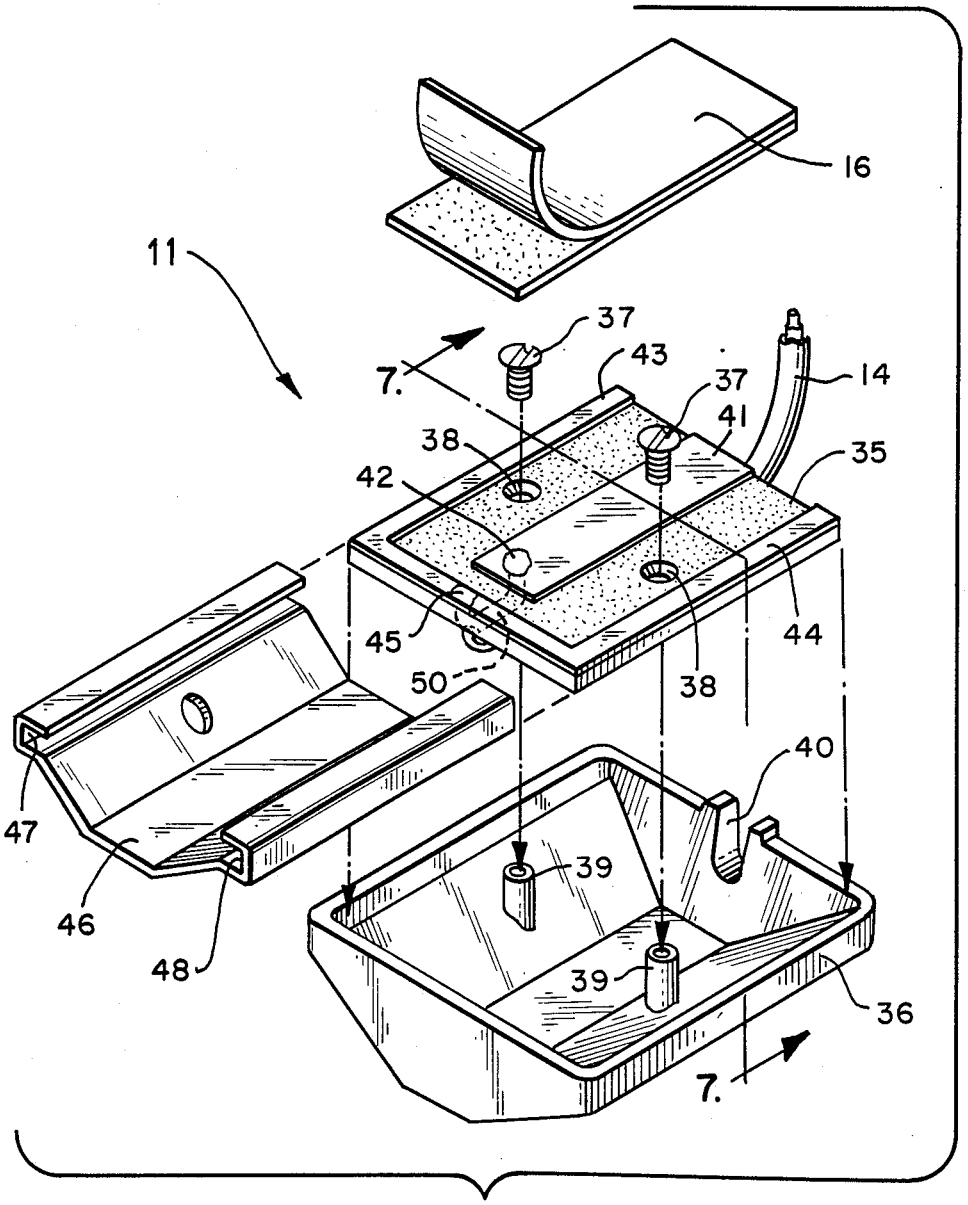
FIG. 6

FIG. 7
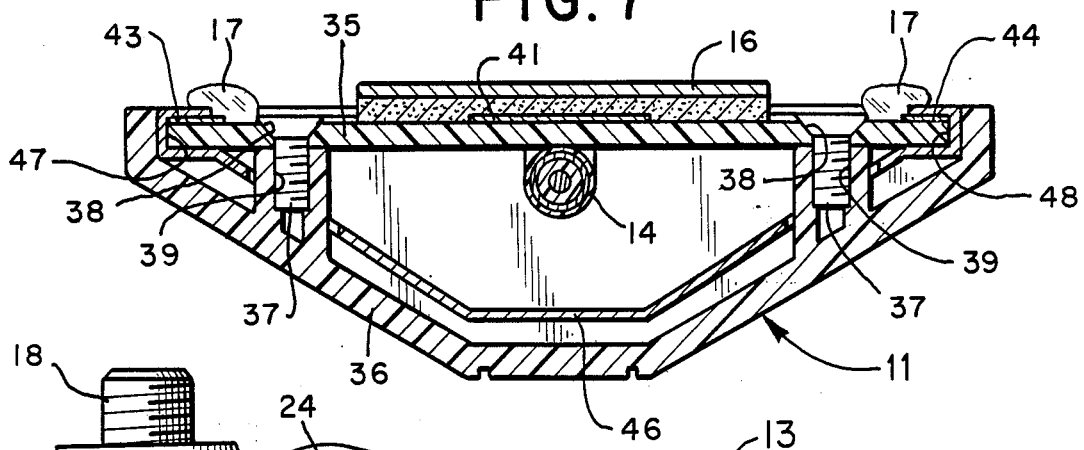
FIG. 8
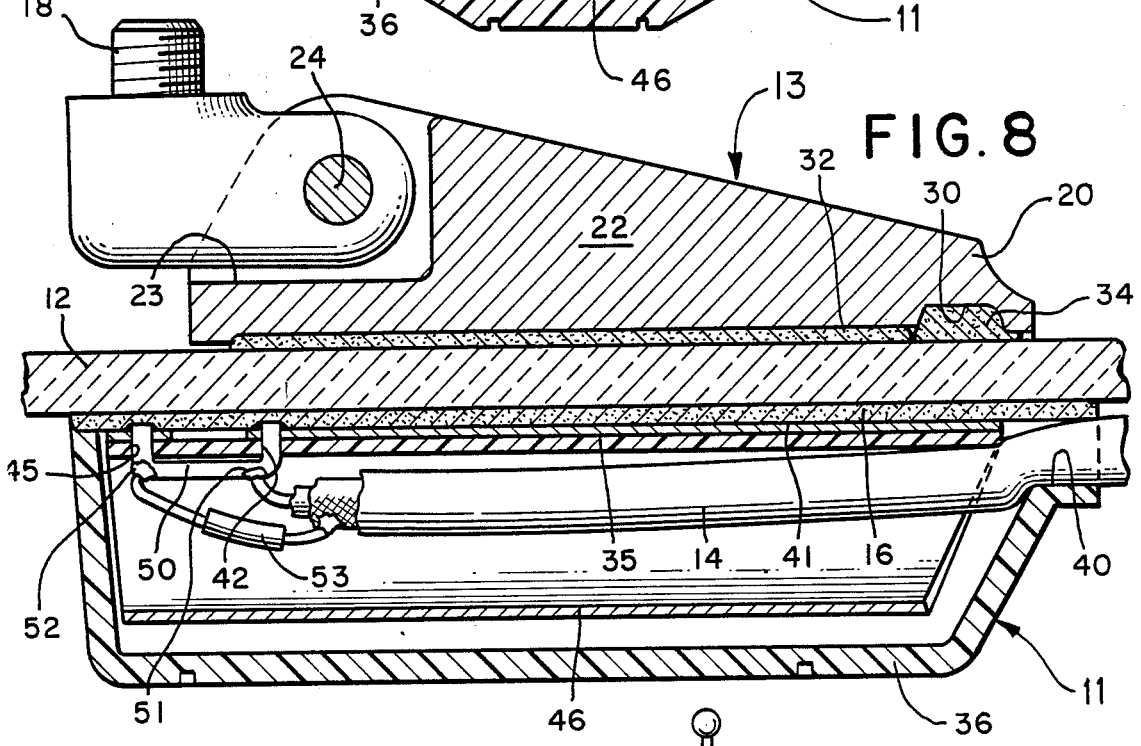
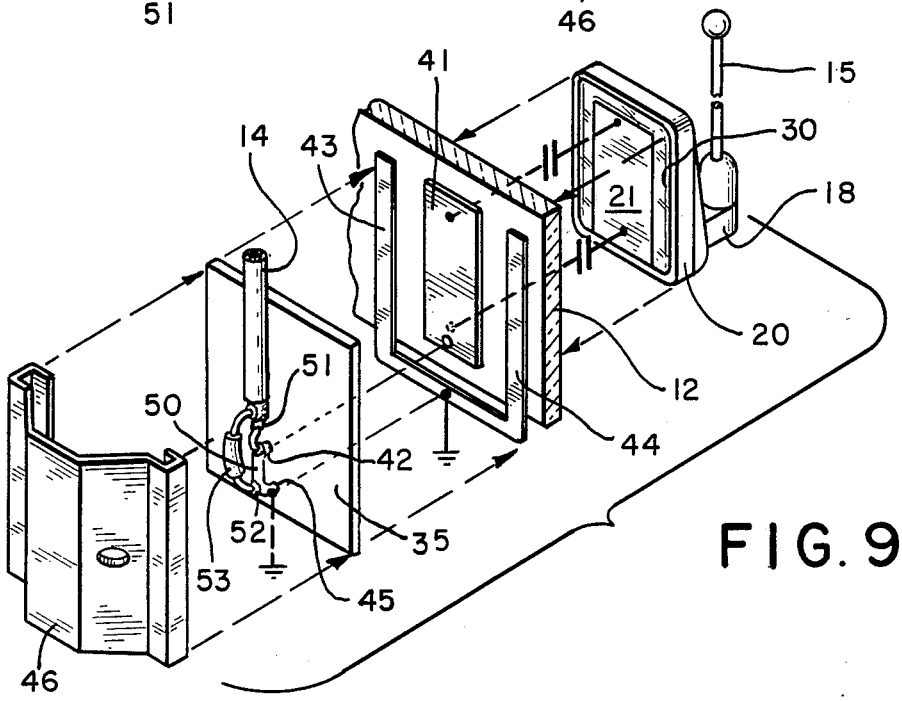
FIG. 9

WINDOW MOUNTED ANTENNA FOR A CELLULAR MOBILE TELEPHONE

BACKGROUND OF THE INVENTION

The present invention is directed generally to mobile antennas, and more specifically to a window-mounted mobile antenna which provides improved performance and economy of manufacture in cellular telephone systems or the like.

With the advent of cellular mobile telephones the need has arisen for antennas which mount on the window of a vehicle, thereby avoiding the need to drill holes in or otherwise modify the vehicle body. Preferably, such window-mounted antennas should offer a degree of performance comparable with body mounted antennas and should be economical to manufacture and easy to install.

Typically, window-mounted antennas include an outside module on the outside of the window glass on which a generally vertical radiating element is mounted, and an inside module on the inside of the glass in registration with the outside module which contains an impedance matching circuit and in some instances a ground plane necessary for operation of the antenna.

For optimum range in cellular mobile telephone applications, it is desirable that the radiation angle of the antenna be low. To this end, it is preferable that the radiating element of the antenna have an electrical length greater than ½ wavelength at the antenna operating frequency In practice, a length of ⅝ wavelength has been found to be optimum in that this length provides a high degree of radiation efficiency and a very low angle of radiation. Furthermore, this length provides a reduced relatively low capacitive base reactance, which can be readily matched to a low impedance coaxial feed line with a single inductor, unlike the inductive reactance of higher base impedance half wave radiating elements.

The use of a ⅝ wavelength radiating element requires that the antenna incorporate in its inside module a ground plane to provide an electrical reference plane and impedance matching means for matching the base impedance of the radiating element to the coaxial feedline. Preferably, this inside module should be as compact and economical to manufacture, and should not require any adjustments on the part of the user. Furthermore, compensation for the capacitive reactance of the capacitive coupling through the glass window should also be accomplished without user-adjustment.

The present invention provides a new and improved window-mounted mobile antenna utilizing a ⅝ wavelength radiating element which meets the above requirement.

SUMMARY OF THE INVENTION

The present invention is directed to an antenna for mounting on the window of a vehicle and adapted for operation at a predetermined frequency in conjunction with a utilization device within the vehicle. The antenna comprises an elongated radiating element having an electrical length of at least ⅝ wavelength and a predetermined capacitive base reactance at the operating frequency, a first coupling member electrically connected to the radiating element, and a second coupling member. Means are provided for mounting the first coupling member on the outside surface of the window and the second coupling member on the inside surface of the window with substantial portions of the coupling members in registration. Means are further provided for forming a ground plane on the inside surface of the window with respect to the radiating element. Impedance matching means comprising an inductor are connected between the second coupling member and the ground plane, the inductor having an inductive reactance at the operating frequency at least equal to the capacitive base reactance. Connection means comprising a coaxial cable having a central conductor electrically connected to the inductor intermediate the ends thereof and a shield conductor connected to the ground plane establish electrical communication between the antenna and the utilization device.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

FIG. 5 is an enlarged cross-sectional view of the outside module showing the mounting particulars of the antenna radiating element.

FIG. 6 is an exploded perspective view of the inside module of the antenna showing the principal elements thereof.

FIG. 7 is an enlarged cross-sectional view of the inside module of the antenna taken along line 7—7 of FIG. 6 showing the module in an assembled condition prior to installation on a vehicle window.

FIG. 8 is an enlarged cross-sectional view of the inside and outside modules of the antenna showing the modules installed on a vehicle window.

FIG. 9 is an exploded perspective view of the principal electrical elements of the antenna.

DESCRIPTION OF THE PREFERRED EMBODIMENT

Figure 1:
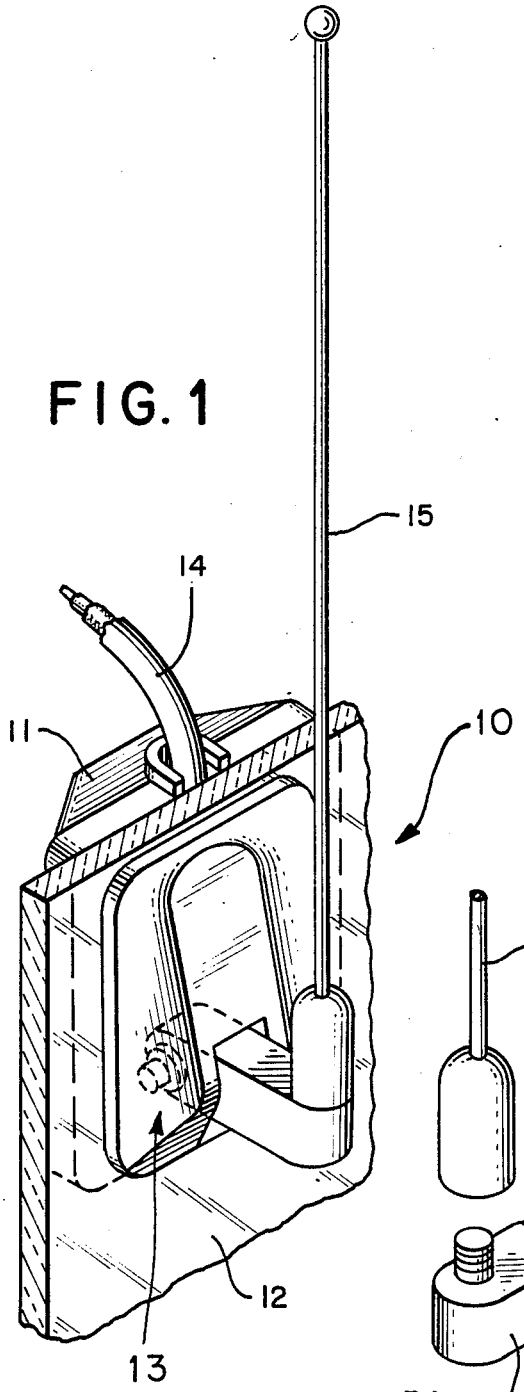
FIG. 1 is a perspective view of a window-mounted mobile telephone antenna constructed in accordance with the invention taken from the exterior of a vehicle window.
Figure 2:
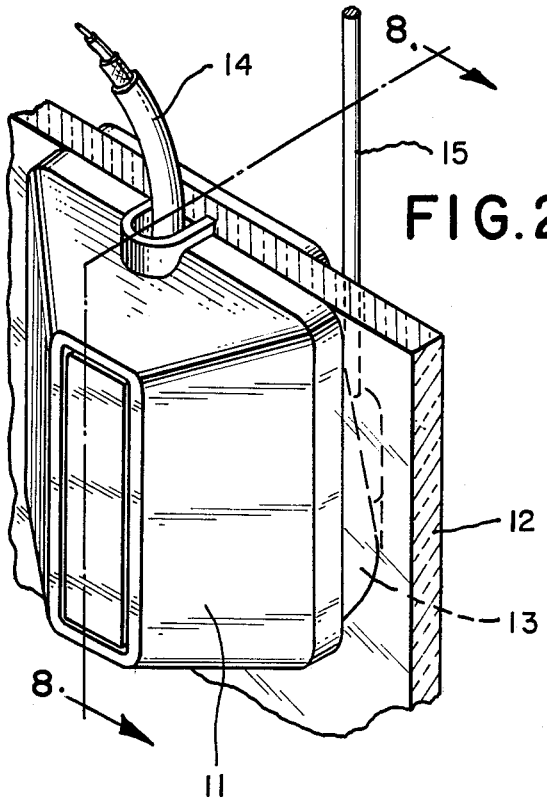
FIG. 2 is an enlarged perspective view of the antenna taken from the interior of the vehicle window.

Referring to the Figures, and particularly to FIGS. 1 and 2, a mobile telephone antenna 10 constructed in accordance with the invention for use in an 800 MHz cellular communications system or the like comprises generally an inside antenna module 11 for mounting on the inside surface of a vehicle window glass 12, and an outside antenna module 13 for mounting in registration with the inside module on the outside surface of the glass. In accordance with conventional practice, RF signals are conveyed to and from the inside module by a coaxial feedline 14, and RF energy is radiated from the outside module 13 by a generally vertical radiating element 15.

The inside antenna module 11, as shown in FIGS. 7 and 8, may be attached to window 12 by a conventional adhesive layer 16 formed from a length of double-sided adhesive tape or the like, and a plurality of dabs 17 of epoxy or other bonding material. Since the inside module is ordinarily not exposed to weather, no special precautions are necessary for protecting adhesive layer 16.

Figure 3:
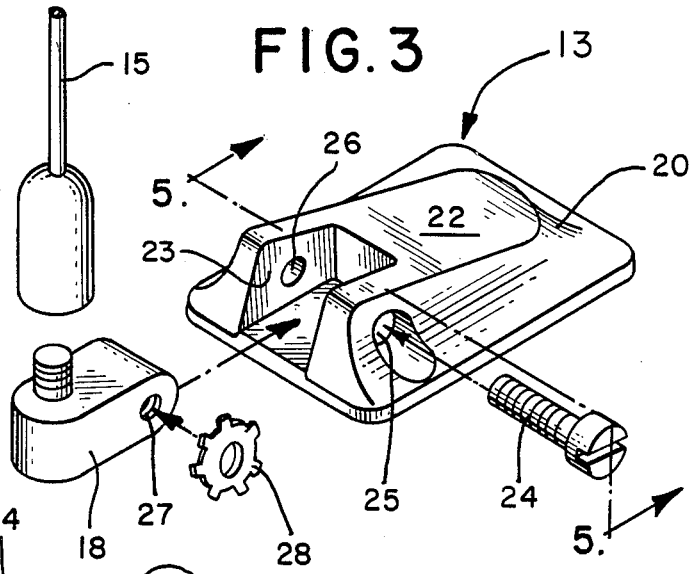
FIG. 3 is an exploded perspective view of the outside module of the antenna showing the principal radiating elements thereof.
Figure 4:
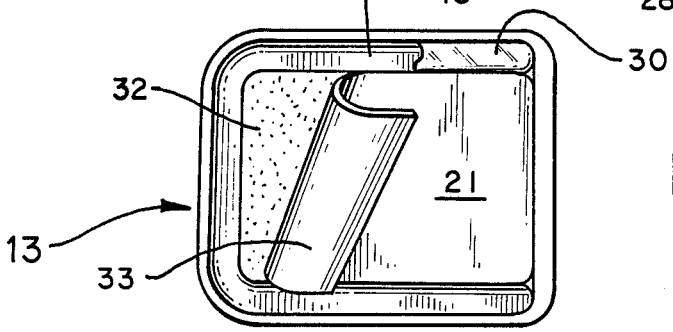
FIG. 4 is a bottom view of the outside module showing the principal window engagement elements thereof prior to installation on a vehicle window.

Referring to FIGS. 3 and 4, the outside antenna module 13 includes a generally rectangular base 20 preferably cast or otherwise formed from an electrically conductive metal such as zinc or aluminum to have a generally flat window engaging portion 21 (FIG. 4) and a generally contoured raised radiating element receiving portion 22 (FIG. 3). The antenna radiating element 15 includes a right-angle base member 18 which is mounted within a notch-shaped recess 23 provided in portion 22 by means of a machine screw 24 extending through cross-bores 25 and 26 provided in the base. Screw 24 is threaded into a bore 27 on element 18 and fitted with a concentric lock washer 28 so that the radiating element can be fixedly secured relative to base 20 by tightening screw 24.

Referring to FIG. 4, the window engaging portion 21 of base 20 advantageously includes, as described in the copending application of Roger K. Fisher, entitled "Adhesive System and Method for Mounting a Cellular Telephone Antenna", Serial No. 194,469, filed concurrently herewith, a channel 30 which extends around a U-shaped portion of the periphery of the engaging portion to form a flat central glass engaging surface surrounded on its top and sides by the channel. An adhesive layer 32 preferably in the form of a conventional double-sided adhesive tape is provided on all or a substantial portion of this surface to facilitate attachment of the outside module to the window. A protective peel-back non-adhesive layer 33 is preferably provided over the exposed adhesive surface of layer 32 to protect the layer prior to installation.

To protect adhesive layer 32 from moisture, water, or contaminants which might with time cause deterioration of the layer and consequential failure of the attachment to the window glass, a bead 34 of silicone adhesive gel is deposited in channel 30 prior to engaging the exposed adhesive surface of adhesive layer 32 to the surface of window 12. The silicone adhesive, which does not solidify or set-up with time, is pressed against the outside surface of window 12 by the adherence of adhesive layer 32 and in expanding forms a water-tight seal around the encircled sides of the layer. This serves to protect adhesive layer 32 from deleterious exposure to water and contaminants.

For most effective protection, it is preferable that base 20 be orientated so that channel 30, and hence silicone bead 34, encircles the top and side edges of adhesive layer 32. This gives protection from rain running down the window, while allowing for insertion of a screwdriver or similar prying tool from the bottom edge when removing the unit from the window.

Referring to FIGS. 6–8, the inside antenna module 11 includes a generally rectangular circuit board 35 formed of a non-conductive material such as glass epoxy. A cover 36 molded of a plastic or other impact-resistant non-conductive material is secured over one side of circuit board 35 by a pair of machine screws 37 which extend through apertures 38 in board 35 and engage threaded apertures 39 in the cover. A slot 40 is preferably provided in the cover to receive coaxial feedline 14.

To provide a capacitive coupling for RF energy through window glass 12, an electrically conductive coupling plate 41 in the form of a thin metallic film is deposited on the window-engaging surface of circuit board 35. Preferably, this plate has dimensions similar to the window engaging surface 21 of outside module 13, and in any event not less than $\frac{1}{8}$ wavelength at the antenna operating frequency, to provide a sufficient capacitive coupling to base 20 and radiating element 15. An aperture 42 (FIG. 8) in circuit board 35 may be provided to facilitate electrical connection to the coupling plate from the other side of the circuit board.

To provide an electrical ground plane for radiating element 15 circuit board 35 further includes a pair of electrically conductive strips 43 and 44 which extend from an aperture 45 in circuit board 35 along respective edges of the board to form generally a U-shaped ground plane element. Preferably, the total length of each ground plane element is $\frac{1}{4}$ wavelength at the antenna operating frequency.

The effectiveness of the antenna ground plane can be improved by providing an additional ground plane element 46 in the form of an elongated channel-like metallic member generally concave in the direction of circuit board 35. The ends of member 46 are formed to provide channel-recesses 47 and 48 (FIG. 6) for receiving the circuit board. Electrical continuity between member 46 and ground plane elements 43 and 44 is established by reason of the channel-recesses, which in the assembled state of antenna module 11 electrically and mechanically engages the ground plane elements and circuit board 35. As a further consequence of the provision of element 46 in module 11, improved RF shielding of coupling plate 42 and its associated circuitry is obtained.

Figure 10:
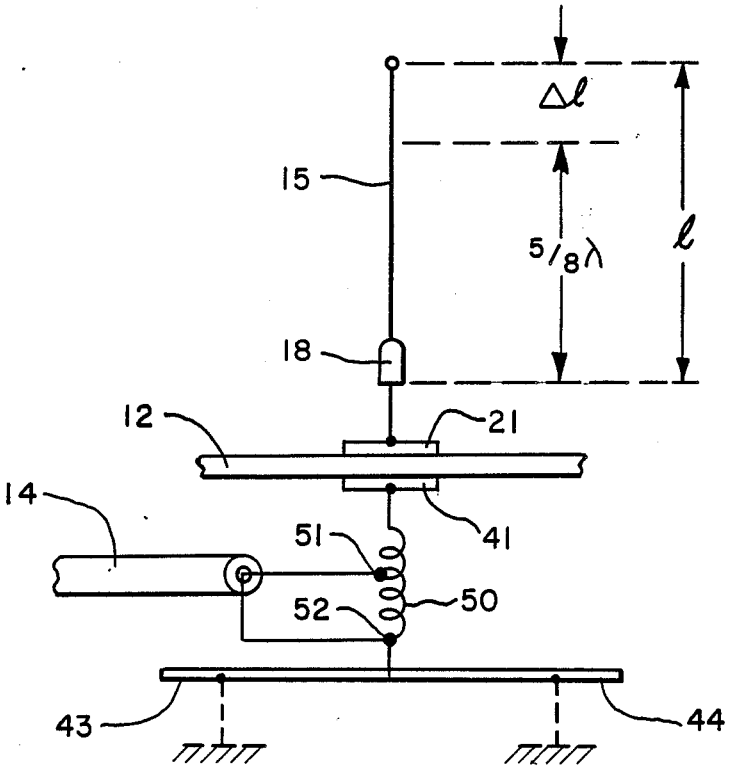
FIG. 10 is a simplified electrical schematic diagram of the antenna.

As a result of use of a radiating element having an electrical length slightly greater than $\frac{3}{8}$ wavelength at the antenna operating frequency, the base impedance of the antenna is capacitive reactive and higher than the characteristic impedance of coaxial feedline 14. Consequently, for maximum power transfer to the antenna an impedance matching circuit employing an inductive reactance is provided in module 11 between feedline 14 and capacitive coupling plate. As shown in FIGS. 8–10, this matching circuit takes the form of a wire segment 50 extending from a solder connection to coupling plate 41 at aperture 42 to a solder connection to ground plane elements 43 and 44 at aperture 45. At the 800–900 MHz operating frequency range of the antenna this wire segment, which may for example consist of a $\frac{3}{8}$ inch length of No. 14 A.W.G. copper wire, comprises an inductive component providing sufficient inductive reactance to match the base impedance of radiating element 15. An impedance match to coaxial feedline 14 is obtained by connecting the center conductor of the feedline at a tap location 51 intermediate the ends of the wire segment, while connecting the shield of the feedline to the wire segment at a top location 52 adjacent ground plane elements 43 and 44. A length of non-conductive heat shrinkable tubing 53 (FIG. 8) may be provided on the shield of feedline conductor to prevent contact with wire segment 50.

As shown in FIG. 10, at 800 MHz wire segment 50 is in effect an inductance connected in series with the window-dielectric coupling capacitor formed by plates 21 and 41 between radiating element 15 and the ground plane formed by elements 43 and 44. Coaxial feedline 14, which has a lower impedance than the base of the $\frac{5}{8}$ wavelength antenna, is connected to a tap location on the inductance which provides a matching impedance.

A further improvement in antenna efficiency can be realized by extending radiating element 15 beyond $\frac{5}{8}$ wavelength a length Δ 1 (FIG. 10) to provide a reduction in the capacitive reactance component at the base of the antenna. Preferably, this reduction is equal to the capacitive reactive component introduced in series with the antenna by the coupling capacitor formed by plates 21 and 41 and window glass 12. As a result of the reduction in capacitive base reactance the inductive reactance required of wire segment 50 in matching the radiating element is reduced, thereby allowing the segment to remain short for minimum loss and radiation within antenna module 11.

As a result of the use of a capacitive coupling plate 21 directly connected to a $\frac{5}{8}$ wavelength radiating element in module 13, and the use of coupling plate 41, connected by a short linear wire segment to a ground plane with impedance matching accomplished by a tap on the segment in module 11, an electrically efficient antenna having a desirable low angle of radiation is achieved with a minimal number of components. As a result of the use of circuit board 35 and the compact structure provided by wire segment 50, ground plane elements 43 and 44, and member 46, a compact antenna module is achieved for use in the vehicle which is economical to manufacture and install.

While a particular embodiment of the invention has been shown and described, it will be obvious to those skilled in the art that changes and modifications may be made therein without departing from the invention in its broader aspects, and, therefore, the aim in the appended claims is to cover all such changes and modifications as fall within the true spirit and scope of the invention.

I claim:

1. An antenna for mounting on the window of a vehicle and adapted for operation at a predetermined operating frequency in conjunction with a utilization device within the vehicle, comprising:

an elongated radiating element having an electrical length of at least $\frac{5}{8}$ wavelength and a predetermined capacitive base reactance at the operating frequency;

a first coupling member electrically connected to said radiating element and having a generally planar surface for engaging the outer surface of the window;

a housing;

a circuit board having a flat window engaging surface disposed within said housing;

a second coupling member comprising a metallic foil on said window engaging surface of said circuit board, said foil having dimensions generally corresponding to the dimensions of said first coupling member;

means for mounting said first coupling member on the outside surface of said window and said circuit board on the inside surface of said window with substantial portions of said coupling members in registration;

means comprising a narrow elongated strip of conductive material disposed in a generally U-shaped configuration around and spaced generally parallel to a substantial portion of the periphery of said second coupling member on said window engaging surface coplanar with said second coupling member for forming a ground plane within said housing relative to said radiating element;

impedance matching means comprising an inductor within said housing connected between said second coupling member and a point on said U-configured strip of conductive material intermediate the ends thereof, said inductor having an inductive reactance at the operating frequency at least equal to said predetermined capacitive base reactance of said antenna; and connection means comprising a coaxial cable extending into said housing and having within said housing a central conductor electrically connected to said inductor between the ends thereof and a shield conductor connected to said connection point on said strip; and said impedance matching means establishing impedance-matched electrical communication between the antenna and the utilization device.

2. An antenna as defined in claim 1 wherein said strip extends in each direction from said connection point at least $\frac{1}{4}$ wavelength at the operating frequency.

3. An antenna as defined in claim 1 wherein said impedance matching inductance comprises a linear wire segment.

4. An antenna for mounting on the window of a vehicle and adapted for operation at a predetermined operating frequency in conjunction with a utilization device within the vehicle, comprising:

a window-mounted antenna module on the outside surface of the window glass, said module including a first electrically conductive coupling member and a generally vertical elongated radiating element extending from said coupling plate for a length of at least $\frac{5}{8}$ wavelength and having a predetermined capacitive base reactance at the operating frequency;

a coaxial feedline having a center conductor and a shield;

a window-mounted antenna module on the inside surface of said window glass, said module including a second generally planar electrically conductive coupling member, a narrow electrically conductive strip coplanar with said second coupling member and arranged in a generally U-shaped configuration around and generally parallel to a substantial portion of the periphery of said coupling member to form a ground plane within said housing relative to said radiating element, and an impedance-matching inductor;

said inductor having an inductive reactance at least equal to the capacitive base reactance of said radiating element, and being connected between said second coupling member and a connection point on said strip intermediate the ends thereof; and said center conductor of said coaxial feedline being connected to said inductor between the ends thereof and said shield of said coaxial feedline being connected to said connection point on said strip to provide within said housing an impedance match between said radiating element and said coaxial feedline.

5. An antenna as defined in claim 4 wherein said strip extends in each direction from said point of connection at least $\frac{1}{4}$ wavelength long at the operating frequency.

6. An antenna as defined in claim 4 wherein said impedance matching inductance comprises a linear wire segment.

* * * * *